US005513569A

United States Patent [19]

Rodi

[11] Patent Number: 5,513,569

[45] Date of Patent: May 7, 1996

[54] METHOD OF CONTROLLING A START-UP OF PAPER TRAVEL IN A PRINTING PRESS

[75] Inventor: Anton Rodi, Leimen, Germany

[73] Assignee: Heidelberger Druckmaschinen AG, Heidelberg, Germany

[21] Appl. No.: 405,459

[22] Filed: Mar. 16, 1995

Related U.S. Application Data

[63] Continuation of Ser. No. 216,619, Mar. 23, 1994, abandoned.

[30] Foreign Application Priority Data

Mar. 23, 1993 [DE] Germany ..... 43 09 266.7

[51] Int. Cl.[6] ..... B41L 35/14

[52] U.S. Cl. ..... 101/488; 101/424.1

[58] Field of Search ..... 101/424.1, 487, 101/488; 347/102; 34/524, 526

[56] References Cited

U.S. PATENT DOCUMENTS

| | | | |
|---|---|---|---|
| 5,060,572 | 10/1991 | Waizmann | 101/424.1 |
| 5,214,442 | 5/1993 | Roller | 101/488 |
| 5,239,613 | 8/1993 | Motev et al. | 101/424.1 |
| 5,280,720 | 1/1994 | Heidt . | |

FOREIGN PATENT DOCUMENTS

| | | |
|---|---|---|
| 0489366 | 6/1992 | European Pat. Off. . |
| 1571704 | 2/1971 | Germany . |
| 3740294 | 6/1988 | Germany . |
| 2198827 | 6/1988 | United Kingdom . |

*Primary Examiner*—Edgar S. Burr
*Assistant Examiner*—Dan J. Colilla
*Attorney, Agent, or Firm*—Herbert L. Lerner; Laurence A. Greenberg

[57] ABSTRACT

Method of controlling a start-up of paper travel and printing, respectively, in a printing press having an electrically operated dryer for printing products printed with ink curable by drying, the dryer being preheatable over a limited time period, includes switching-on a drive for effecting paper travel and printing, respectively, after the dryer, which has been switched on beforehand, has reached a limit value representing optimum operating conditions.

2 Claims, 2 Drawing Sheets

METHOD OF CONTROLLING A START-UP OF PAPER TRAVEL IN A PRINTING PRESS

Figure 1:
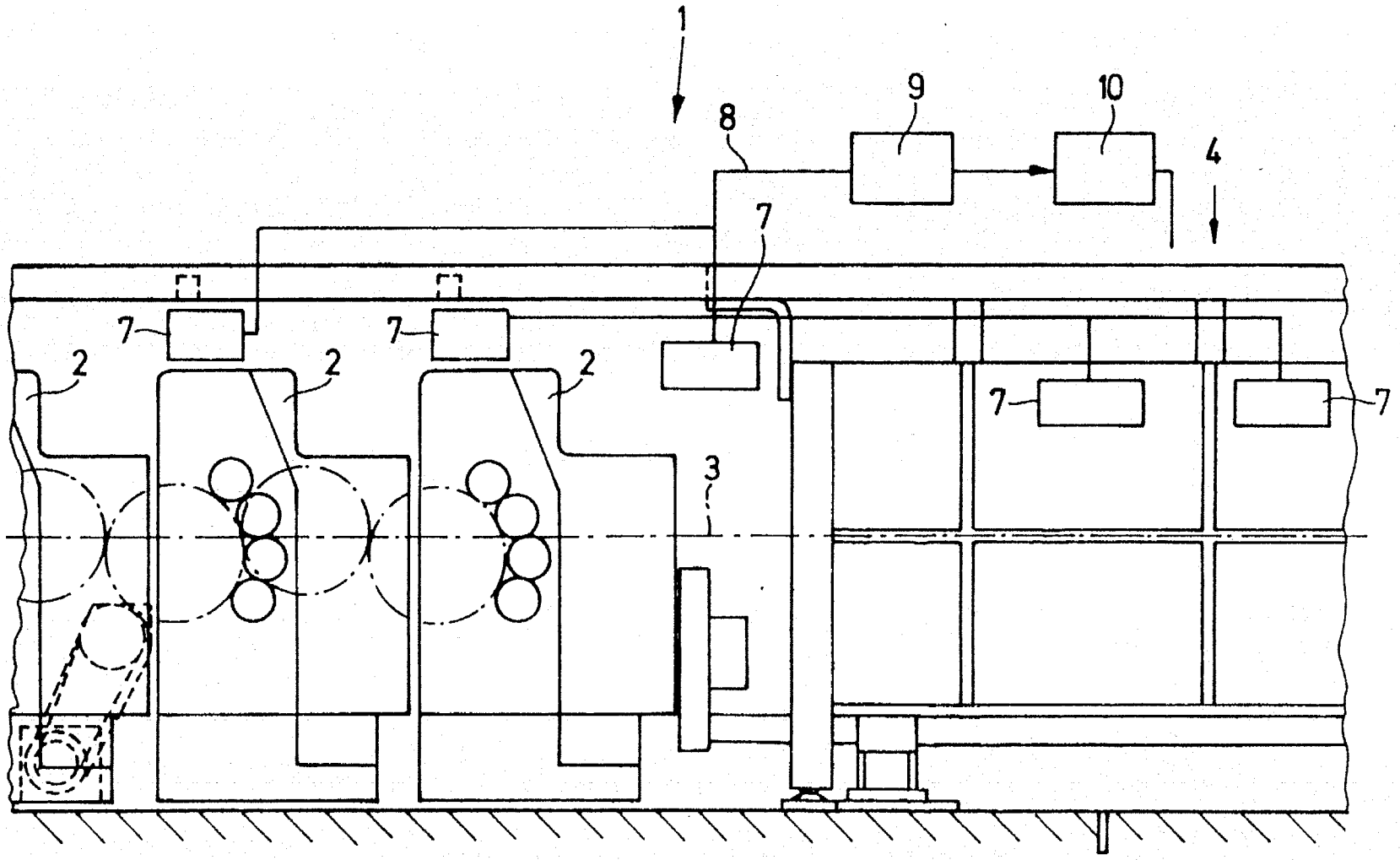

This application is a continuation of application Ser. No. 08/216,619, filed Mar. 23, 1994, now abandoned.

The invention relates to a method of controlling a start-up of paper travel and printing (ink, varnish), respectively, in a printing press having an electrically operated dryer for printed products printed with ink curable by drying, the dryer being preheatable over a limited time period.

During the start-up phase of operation of a printing press, the production of paper waste or spoilage is due largely to the use of ultraviolet (UV) inks and inks cured by a drying process, the printed product being conveyed into the dryer in the preheating phase, i.e., before the dryer has reached a drying temperature corresponding to optimum operating conditions. This results in a smearing or smudging and a blocking or sticking-together of the first printed products of a sheet-fed printing press and a smearing or smudging of the starting end of a printed web in web printing, respectively.

Devices for reducing the paper waste or spoilage produced in the start-up phase of a printing press have become known heretofore, however, precautionary measures taken therewith are concerned either with the activation of all adjusting processes prior to the paper travel, the pre-conditioning of the inking units, the pre-inking of the printing plate and the blanket, respectively, or to the pre-setting of the ink/water balance independently of one another.

It has also become known from the German Published Non-Prosecuted Patent Application (DE-OS) 15 71 704 to permit certain switch-on or starting operations of a machine unit to take place only after the operating temperature of a dryer integrated into the machine unit has been reached. This is described in this publication with respect to a briquette press.

It is an object of the invention of the instant application to provide a method of controlling a start-up of paper travel and printing, respectively, during a start-up phase in a printing press, more particularly, a sheet-fed offset printing press with an electrically operated, after-connected dryer for UV inks or inks cured by drying, which avoids the production of spoilage or waste due to smearing or smudging of non-cured inks applied during the printing.

With the foregoing and other objects in view, there is provided, in accordance with the invention, a method of controlling a start-up of paper travel and printing, respectively, in a printing press having an electrically operated dryer for printing products printed with ink curable by drying, the dryer being preheatable over a limited time period, which comprises switching-on a drive for effecting paper travel and printing, respectively, after the dryer, which has been switched on beforehand, has reached a limit value representing optimum operating conditions.

As a result of this method according to the invention, the dryer reaches its optimum operating conditions before the first printed sheet leaves a sheet-fed printing press and before a starting end of a printed paper web enters the dryer, respectively. The required start-up sequence is determinable in various different ways.

In accordance with another mode, the inventive method includes determining the respective limit value of a sequence for the start-up of paper travel and printing, respectively, as a function of ambient temperature, the respective ink and varnish used and the thickness of a layer thereof, respectively, time of paper travel through the printing press to the dryer, air volume of the drying oven and desired drying temperature or heating power; and starting-up the paper travel and the printing, respectively, at an instant of time before the temperature in the dryer reaches an optimum drying temperature and so that the printing product enters the dryer just when the drier has reached its optimum drying temperature.

On the one hand, this procedure avoids unnecessary time delay and, on the other hand, it ensures that the fresh printing or varnish on the printed product has been cured when leaving the drier.

In accordance with a concomitant mode of the invention, the method includes empirically determining a start-up temperature within the dryer corresponding to the respective limit value of a sequence for the start-up of paper travel and printing, respectively; and switching-on the dryer beforehand at the an empirically determined start-up temperature. Thus, the limit value for the start-up sequence of the paper travel corresponds to an empirically determined start-up temperature of the dryer switched on beforehand. In this case, it is empirically determined at which drying temperature the paper travel and the printing process may be started so that, after having left the printing press, the first printed product does not enter the dryer before the dryer has reached its optimum operating conditions.

Other features which are considered as characteristic for the invention are set forth in the appended claims.

Although the invention is illustrated and described herein as a method of controlling a start-up of paper travel and printing, respectively, it is nevertheless not intended to be limited to the details shown, since various modifications and changes may be made therein without departing from the spirit of the invention and within the scope and range of equivalents of the claims.

Figure 2:
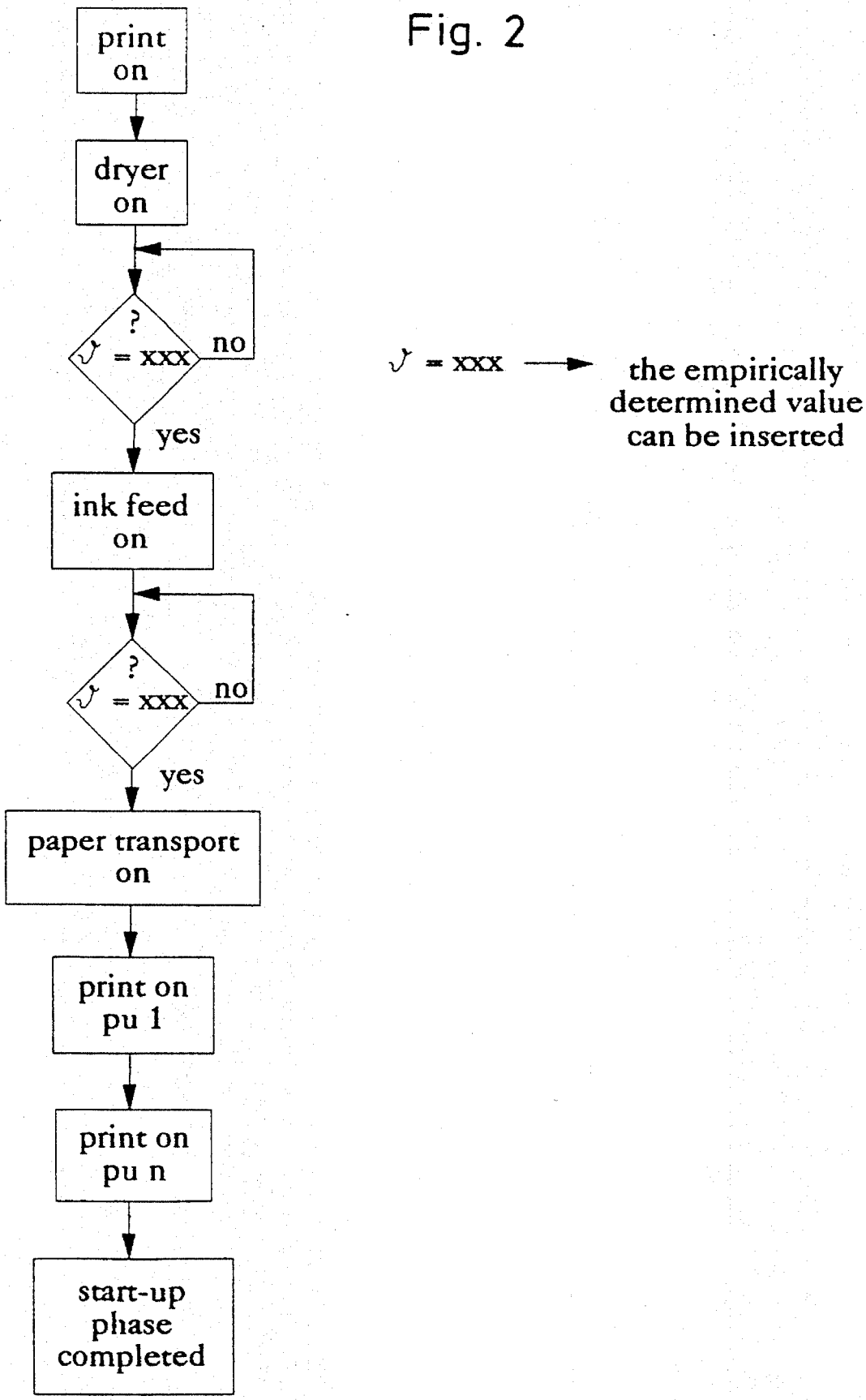

The method of operation of the invention, however, together with additional objects and advantages thereof will be best understood from the following description of specific modes when read in connection with the accompanying drawings, in which:

FIG. 1 is a fragmentary diagrammatic, side elevational view of a web-fed printing press and dryer for performing the method according to the invention; and FIG. 2 is a flow chart for performing the controlled preheating of the dryer in accordance with a mode of the method invention.

Referring now to the drawings and, first, particularly to FIG. 1 thereof, there is shown therein a dryer 4 after-connected to a printing press 1, namely a web-fed printing press, by way of example. In this regard, it is noted that the method invention of the instant application is also equally applicable to a sheet-fed printing press. A web 3 of material, such as paper, is drawn into printing units 2, i.e. the printing units pu 1, pu 2 . . . pu n, of the web-fed printing press 1 where printing with various ink colors, for example, is successively performed thereon. Thereafter, the freshly printed web 3 enters the dryer 4 wherein it is heated up to suitable conventional temperatures, such as 150° to 180° C. Measuring data are transmitted from respective conventional monitoring or data-storage devices 7 regarding ambient temperature, the respective ink and varnish used and the layer thickness thereof, respectively, time of paper travel through the printing press 1 to the dryer 4, thickness of the respective ink or varnish layer, air volume of the drying oven and desired drying temperature or heating power, to a microprocessor 9 via a data line 8.

In accordance with a suitable program derived from the flow chart of FIG. 2, a respective limit value of a start-up sequence for paper or web travel and the printing operation, respectively, is determined as a function of the foregoing parametric values by the microprocessor 9 which starts the paper travel through the printing press 1 by suitably throwing a switch 10 at a calculated time before an optimum drying temperature is reached in the dryer 4, so that the printing product enters the dryer 4 just when the dryer 4 has reached the optimum drying temperature thereof.

The limit value of the start-up sequence for the paper web or sheet travel and the printing operation, respectively, corresponds to an empirically determined start-up temperature in the previously switched-on dryer 4. Reference may be had to the flow chart of FIG. 2 for the application of the empirically determined start-up temperature value in the method invention. At 10, the printing press is turned on, followed by turning on the dryer at 11. Only if the empirically determined temperature value ν=xxx has been reached, is the ink feed turned on at 12. Similarly, only if the empirically determined value ν=xxx has been reached, is the paper, i.e., web or sheet, travel or transport turned on at 13. Then the printing units pu 1 . . . pu n are successively turned on at 14 and 15 and the start-up phase is completed at 16.

I claim:

1. Method of controlling a start-up of paper travel and printing, respectively, in a printing press having an electrically operated dryer for printing products printed with ink curable by drying, the dryer being preheatable over a limited time period, which comprises:

determining a limit value representing optimum operating conditions of a dryer and a sequence for the start-up of paper travel and printing, respectively, as a function of ambient temperature, a respective ink and varnish used and a thickness of a layer thereof, time of paper travel through the printing press to the dryer, air volume of a drying oven of the dryer, and desired drying temperature or heating power;

switching-on the dryer for heating the dryer; and subsequently switching-on a drive for effecting paper travel and printing for starting-up the paper travel and the printing, respectively, at an instant of time before the temperature in the dryer reaches an optimum drying temperature, such that the printing product enters the dryer just when the dryer has reached its optimum drying temperature.

2. Method according to claim 1, which includes empirically determining a start-up temperature within the dryer corresponding to the respective limit value of a sequence for the start-up of paper travel and printing, respectively, and switching-on the dryer beforehand at the empirically determined start-up temperature.

* * * * *